US007606386B2

(12) United States Patent
Kang et al.

(10) Patent No.: US 7,606,386 B2
(45) Date of Patent: Oct. 20, 2009

(54) VIBRATION ACTUATOR

(75) Inventors: Dae Lyun Kang, Suwon (KR); Dai Gil Lee, Daejeon (KR); Sang Wook Park, Nam-ku (KR); Hak Sung Kim, Asan (KR); Seuk Hwan Chung, Yongin (KR); Seong Geun Kim, Suwon (KR); Sang Won Kim, Seoul (KR); Jun Kun Choi, Suwon (KR)

(73) Assignee: Samsung Electro-Mechanics Co., Ltd., Suwon, Kyungki-Do (KR)

( * ) Notice: Subject to any disclaimer, the term of this patent is extended or adjusted under 35 U.S.C. 154(b) by 792 days.

(21) Appl. No.: 11/105,502

(22) Filed: Apr. 14, 2005

(65) Prior Publication Data

US 2006/0174688 A1 Aug. 10, 2006

(30) Foreign Application Priority Data

Feb. 4, 2005 (KR) ..... 10-2005-0010702

(51) Int. Cl.
*H04R 1/00* (2006.01)

(52) U.S. Cl. ..... 381/396; 381/380; 381/412

(58) Field of Classification Search ..... 381/150–152, 381/190–191, 326, 380, 396; 340/388.1, 340/391.1

See application file for complete search history.

(56) References Cited

U.S. PATENT DOCUMENTS 6,211,775 B1 * 4/2001 Lee et al. ..... 340/407.1
6,590,991 B1 7/2003 Maeda
6,753,630 B1 * 6/2004 Ueda et al. ..... 310/81
7,280,020 B2 * 10/2007 Reynolds et al. ..... 335/229

FOREIGN PATENT DOCUMENTS

| | | | |
|---|---|---|---|
| CN | 1317168 | A | 10/2001 |
| JP | 2000-023438 | A | 1/2000 |
| JP | 2004-105816 | | 4/2004 |
| JP | 2004-202327 | A | 7/2004 |

OTHER PUBLICATIONS

Japanese Patent Office, Office Action mailed Nov. 13, 2007 and English Translation.
Korean Intellectual Property Office Office Action, mailed Jul. 31, 2006.
SIPO Office Action and English Translation.

* cited by examiner

*Primary Examiner*—Curtis Kuntz
*Assistant Examiner*—Ryan C Robinson
(74) *Attorney, Agent, or Firm*—Lowe Hauptman Ham & Berner

(57) ABSTRACT

A vibration actuator excites a mass member by interaction between an electric field of a vibration coil provided in an inner space of a case and a magnetic field of a magnetic field unit disposed corresponding to the vibration coil. The vibration actuator has an elastic wire having a wire body fixed to the outer surface of the mass member and elastic ends fixed to the inner surface of the case. The elastic wire is connected between the case and the mass member for elastically supporting mass member.

13 Claims, 21 Drawing Sheets

VIBRATION ACTUATOR

RELATED APPLICATIONS

The present application is based on, and claims priority from, Korean Application Number 2005-10702, filed Feb. 4, 2005, the disclosure of which is incorporated by reference herein in its entirety.

BACKGROUND OF THE INVENTION

1. Field of the Invention

The present invention relates to a vibration actuator, and, more particularly, to a vibration actuator that is capable of minimizing change of natural frequency due to manufacturing tolerance of raw materials to improve vibration characteristics of the vibration actuator, simplifying and reducing a manufacturing process to improve productivity of the vibration actuator, and improving durability to increase the service life of the vibration actuator.

2. Description of the Related Art

Generally, a mobile communication device, such as a mobile phone or a pager, incorporates a vibration actuator that is capable of individually or simultaneously outputting sound or vibration. The vibration actuator outputs a voice signal, which is electrically or electronically received, or a previously inputted bell or melody as audible sound, or resonates at a specific frequency to output an incoming signal as vibration that a person can feel.

FIG. 13 is a cross-sectional view illustrating a conventional vibration actuator 1. As shown in FIG. 13, the conventional vibration actuator 1 comprises a case 1*a* formed in the shape of a hollow cylinder. The case 1*a* has an opened lower part, which is closed by a shield plate 2. Also, the case 1*a* has an opened upper part, at which is securely mounted a diaphragm 3, which is a sound-generation oscillating plate, by a supporting ring 13, which is separately fixed to the case 1*a*. Specifically, the outer-circumferential part of the diaphragm 3 is securely inserted in the inner wall of the case 1*a*. To the center of the lower surface of the diaphragm 3 is securely fixed a voice coil 4.

Between the shield plate 2 and the diaphragm 3 is disposed a plate spring 5, which comprises a spring body 5*a* having an opened center part and a plurality of elastic legs 5*b* extending from the spring body 5*a*. The elastic legs 5*b* are securely fixed to the inner wall of the case 1*a*.

To the lower surface of the plate spring 5 is integrally attached an upper surface of a mass member 6. The mass member 6 has a mounting hole 6*a* formed through the center thereof such that a yoke 7 is inserted in the mounting hole 6*a* of the mass member and an engaging protrusion 6*b* extending from the outer circumferential part thereof such that the engaging protrusion 6*b* is engaged with the inner circumferential surface of the case 1*a*.

On the upper surface of the yoke 7, which is inserted in the mounting hole 6*a* of the mass member 6, is mounted a vertically magnetized magnet member 8. On the magnet member 8 is disposed an upper plate 9. The yoke 7, the magnet member 8, and the upper plate 9 constitute a magnetic field unit 10.

On the upper surface of the shield plate 2 is mounted a vibration coil 11, which is disposed directly under the yoke 7.

When electric current is supplied to the vibration coil 11, the mass member 6, including the magnetic field unit 10, is excited by an elastic force of the plate spring 5 due to interaction between the electric field generated by the vibration coil 11 and the magnetic field generated by the magnetic field unit 10. As a result, the vibration actuator is vibrated.

When electric current is supplied to the voice coil 4, the diaphragm 3 is oscillated due to interaction between the electric field generated by the voice coil 4 and the magnetic field generated by the magnetic field unit 10. As a result, sound is generated from the vibration actuator.

The plate spring 5 provided at the conventional vibration actuator 1 is manufactured by processing a thin metal sheet according to a pressing process and a wire discharging process. During the pressing process and the wire discharging process, minute defects and cracks are generated at the cut surface of the plate spring. As a result, fatigue lifetime of the plate spring 5 is decreased, and therefore, the service life of the vibration actuator 1 is reduced.

When the thickness of the plate spring 5 is changed by approximately 1 μm, stiffness of the plate spring 5 is increased or decreased by 2 gf/mm. Such stiffness change of the plate spring 5 directly affects natural frequency of the plate spring 5. For this reason, it is necessary to strictly control the thickness of the plate spring 5, which elastically supports the entire vibrator, including the mass member 6 and the magnetic field unit 10. However, it is difficult to strictly control the thickness of the plate spring 5 due to the manufacturing process of the plate spring 5, and therefore, it is difficult to uniformly maintain the natural frequency of the vibration actuator 1.

The mass member 6 is attached to the spring body 5*a* of the plate spring 5 by spot welding while the upper surface of the mass member 6 is in contact with the lower surface of the spring body 5*a* of the plate spring 5, and ends of the elastic legs of the plate spring 5 are fixed to the inner circumferential surface of the case 1*a*.

The natural frequency of the vibration actuator 1 is sharply changed depending upon positions where the spot welding operation between the plate spring 5 and the mass member 6 has been performed, and therefore, the vibration characteristics of the vibration actuator 1 is deteriorated. Furthermore, the manufacturing process of the vibration actuator 1 is complicated, and therefore, productivity of the vibration actuator 1 is decreased.

SUMMARY OF THE INVENTION

Therefore, the present invention has been made in view of the above problems, and it is an object of the present invention to provide a vibration actuator that is capable of improving durability of an elastic member for elastically supporting a vibrator comprising a magnetic field unit and a mass member, thereby increasing the service life of the vibration actuator.

It is another object of the present invention to provide a vibration actuator that is capable of uniformly maintaining natural frequency of an elastic member for elastically supporting a vibrator comprising a magnetic field unit and a mass member, thereby guaranteeing uniform performance of the vibration actuator and improving vibration characteristics of the vibration actuator.

It is yet another object of the present invention to provide a vibration actuator that is capable of simplifying assembly of a mass member and an elastic member, thereby improving productivity of the vibration actuator.

In accordance with one aspect of the present invention, the above and other objects can be accomplished by the provision of a vibration actuator for exciting a mass member by interaction between an electric field of a vibration coil provided in an inner space of a case and a magnetic field of a magnetic field unit disposed corresponding to the vibration coil, wherein the vibration actuator comprises: an elastic wire having a wire body fixed to the outer circumferential surface of the mass member and elastic ends fixed to the inner circumferential surface of the case, the elastic wire being connected between the case and the mass member for elastically supporting the mass member.

Preferably, the mass member has a disposition groove formed, in a helical shape having at least one turn, at the outer circumferential surface thereof.

Preferably, the elastic wire is composed of a coil spring comprising a coil body disposed in the disposition groove and elastic ends fixed to the inner circumferential surface of the case.

Preferably, the wire body of the elastic wire is wound around the disposition groove of the mass member or forcibly fitted in the disposition groove of the mass member.

Preferably, the mass member comprises: at least two mass disks having different diameters, the at least two mass disks being disposed while being vertically stacked; and a disposition groove provided between the at least two mass disks for allowing the middle part of the elastic wire to be disposed therein.

Preferably, the mass member comprises: a hollow outer mass part having a disposition groove formed at the outer circumferential surface thereof, in a helical shape having at least one turn, and a center hole formed through the center thereof, the center hole having a predetermined size; and an inner mass part inserted in the center hole.

More preferably, the mass member is made of a resin material having the disposition groove formed by molding.

Preferably, the magnetic field unit comprises: a yoke fixed to the mass member; and a magnet mounted in the yoke. More preferably, the magnetic field unit further comprises: an upper plate disposed on the upper surface of the magnet.

Preferably, the vibration actuator further comprises: a shield plate for closing an opened lower part of the case, the vibration coil being disposed on the upper surface of the shield plate.

Preferably, the vibration actuator further comprises: a voice coil disposed at an opened upper part of the case for generating an electric field when electric current is supplied to the voice coil; and a diaphragm attached to the lower surface of the voice coil.

In accordance with another aspect of the present invention, there is provided a vibration actuator for exciting a mass member by interaction between an electric field of a vibration coil provided in an inner space of a case and a magnetic field of a magnetic field unit disposed corresponding to the vibration coil, wherein the mass member has a disposition hole formed therein such that both ends of the disposition hole are exposed to the outside at the outer circumferential surface of the mass member, and the vibration actuator comprises: at least one elastic wire having a wire body disposed in the disposition hole of the mass member and elastic ends fixed to the inner circumferential surface of the case, the at least one elastic wire being connected between the case and the mass member for elastically supporting the mass member.

Preferably, the mass member comprises: an upper mass member having an upper disposition groove formed at the lower surface thereof; and a lower mass member having a lower disposition groove formed at the upper surface thereof, the upper disposition groove and the lower disposition groove being vertically coupled with each other to form the disposition hole.

Preferably, the mass member comprises: an upper mass member; a lower mass member; and a disposition groove formed at one of the surfaces of the upper and lower mass members opposite to each other when the upper mass member and the lower mass member are coupled with each other to form the disposition hole. More preferably, one of the upper and lower mass members is composed of a plate for covering the disposition groove to form the disposition hole.

More preferably, the disposition hole is formed in the shape of a straight line or a curved line.

Preferably, the upper and lower mass members have the same size and weight, or the upper and lower mass members have different sizes and weights.

Preferably, the upper and lower mass members are vertically coupled with each other by a plurality of coupling members, by welding, or by a bonding agent.

Preferably, the elastic wire is composed of a wire comprising: a wire body disposed in the disposition hole of the mass member; and a pair of elastic ends extending along the outer circumferential surface of the mass member and securely fixed to the inner circumferential surface of the case. Alternatively, the elastic wire may be composed of at least two wires, each comprising: one end fixedly disposed in the disposition hole of the mass member; and an elastic end extending along the outer circumferential surface of the mass member and securely fixed to the inner circumferential surface of the case.

Preferably, the mass member is a weight having at least two fixing holes formed at the outer circumferential surface thereof while being spaced uniformly apart in the circumferential direction, and the elastic wire is composed of at least two wires each having one end fixedly inserted in the corresponding fixing hole of the mass member and an elastic end extending along the outer circumferential surface of the mass member and securely fixed to the inner circumferential surface of the case.

Preferably, the mass member is a weight comprising: an upper mass member having a mounting hole formed therethrough and an upper groove formed at the lower surface thereof; and a lower plate having a lower groove formed at the upper surface thereof such that the lower groove and the upper groove together form a disposition space where the elastic wire is disposed when the lower groove is vertically coupled with the upper groove, and the elastic wire is composed of at least two wires disposed between the upper mass member and the lower plate, each of the at least two wires having an elastic end extending along the outer circumferential surface of the mass member and securely fixed to the inner circumferential surface of the case.

Preferably, the mass member is a weight comprising: an upper mass member having an upper mounting hole formed therethrough and an upper groove formed at the lower surface thereof; a lower mass member having a lower mounting hole formed therethrough, the lower mounting hole corresponding to the upper mounting hole, and a first intermediate groove formed at the upper surface thereof, which corresponds to the upper groove, the lower mass member being vertically coupled with the upper mass member; and a lower plate having a lower groove formed at the upper surface thereof, which corresponds to a second intermediate groove formed at the lower surface of the lower mass member, the lower plate being vertically coupled with the lower mass member, and the elastic wire is composed of a pair of upper and lower wires disposed between the upper mass member and the lower mass member and between the lower mass member and the lower plate, respectively, each of the upper and lower wires having an elastic end extending along the outer circumferential surface of the mass member and securely fixed to the inner circumferential surface of the case.

Preferably, the mass member is a weight comprising: a mass body having a mounting hole formed through the center thereof; and a fixing groove formed at the upper surface of the mass body for allowing one end of the at least one elastic wire to be vertically inserted therein, and the elastic wire is composed of at least two wires each having an elastic end extending along the outer circumferential surface of the mass member and securely fixed to the inner circumferential surface of the case.

Preferably, the magnetic field unit comprises: a yoke fixed to the mass member; and a magnet mounted in the yoke. More preferably, the magnetic field unit further comprises: an upper plate disposed on the upper surface of the magnet.

Preferably, the vibration actuator further comprises: a shield plate for closing an opened lower part of the case, the vibration coil being disposed on the upper surface of the shield plate.

Preferably, the vibration actuator further comprises: a voice coil disposed at an opened upper part of the case for generating an electric field when electric current is supplied to the voice coil; and a diaphragm attached to the lower surface of the voice coil.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, preferred embodiments of the present invention will be described in detail with reference to the accompanying drawings.

Figure 1:
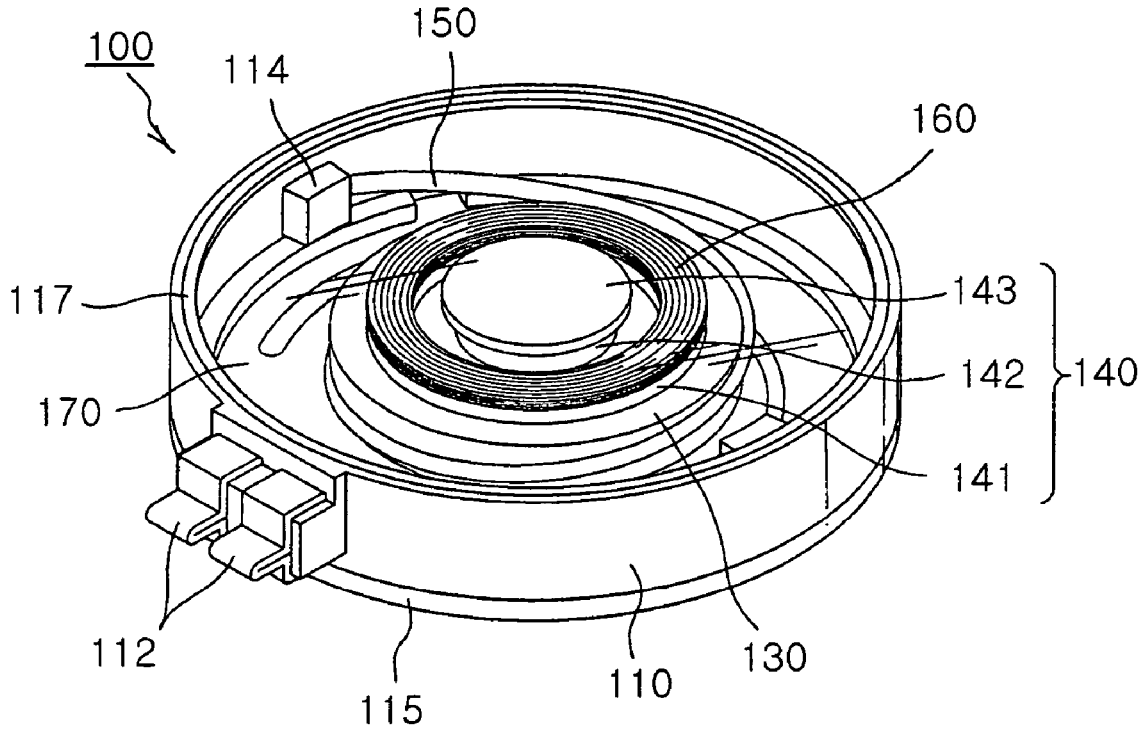
FIG. 1 is an assembled perspective view illustrating a vibration actuator according to a first preferred embodiment of the present invention.
Figure 2:
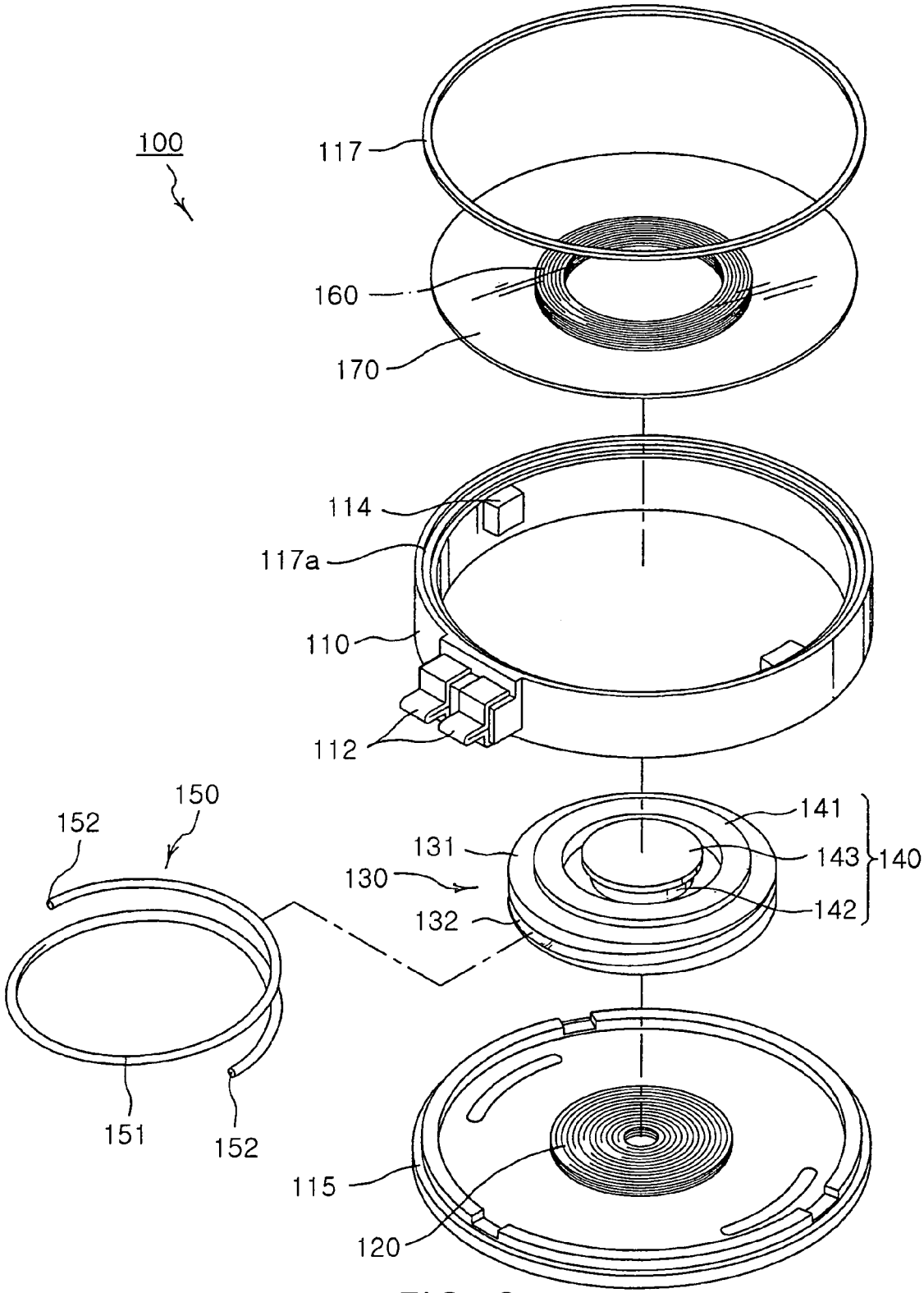
FIG. 2 is an exploded perspective view illustrating the vibration actuator according to the first preferred embodiment of the present invention.

FIG. 1 is an assembled perspective view illustrating a vibration actuator 100 according to a first preferred embodiment of the present invention, and FIG. 2 is an exploded perspective view illustrating the vibration actuator 100 according to the first preferred embodiment of the present invention.

The vibration actuator 100 according to the first preferred embodiment of the present invention is incorporated in a wireless communication device for vertically exciting a vibrator due to interaction between an electric field and a magnetic field to generate an incoming signal as vibration that a person can feel, and to generate a voice signal or a previously inputted bell or melody as audible sound. As shown in FIGS. 1 and 2, the vibration actuator 100 comprises a case 110, a vibration coil 120, a mass member 130, a magnetic field unit 140, and an elastic wire 150.

The case 110 is an accommodating member having an inner space of a predetermined size defined therein such that a plurality of components is accommodated in the inner space of the case 110.

The case 110 has an opened lower part, to which a shield plate 115 is fixed to protect the inner space, which may be formed in the shape of a circle or an oval according to the form of the wireless communication terminal, from the outer environment.

The vibration coil 120 is disposed on the upper surface of the shield plate 115, which corresponds to the magnetic field unit 140, for generating an electric field having a predetermined strength such that the vibration coil 120 outputs vibration due to interaction between the electric field of the vibration coil 120 and a magnetic field generated by the magnetic field unit 140.

The mass member 130 is a weight vertically movably disposed in the inner space of the case 110 via the elastic wire 150. At the outer circumferential surface of the mass member 130 is formed a disposition groove 132, in which a wire body 151 of the elastic wire 150 is disposed, while being exposed to the outside.

The elastic wire 150 is an elastic member disposed between the case 110 and the mass member 130. The wire body 151 of the elastic wire 150 is disposed in the disposition groove 132 formed at the outer circumferential surface of a mass body 131 of the mass member 130 for elastically supporting the mass member 130 in the inner space of the case 110. The elastic wire 150 also has elastic ends 152, which are fixed to the inner circumferential surface of the case 110.

Figure 3A:
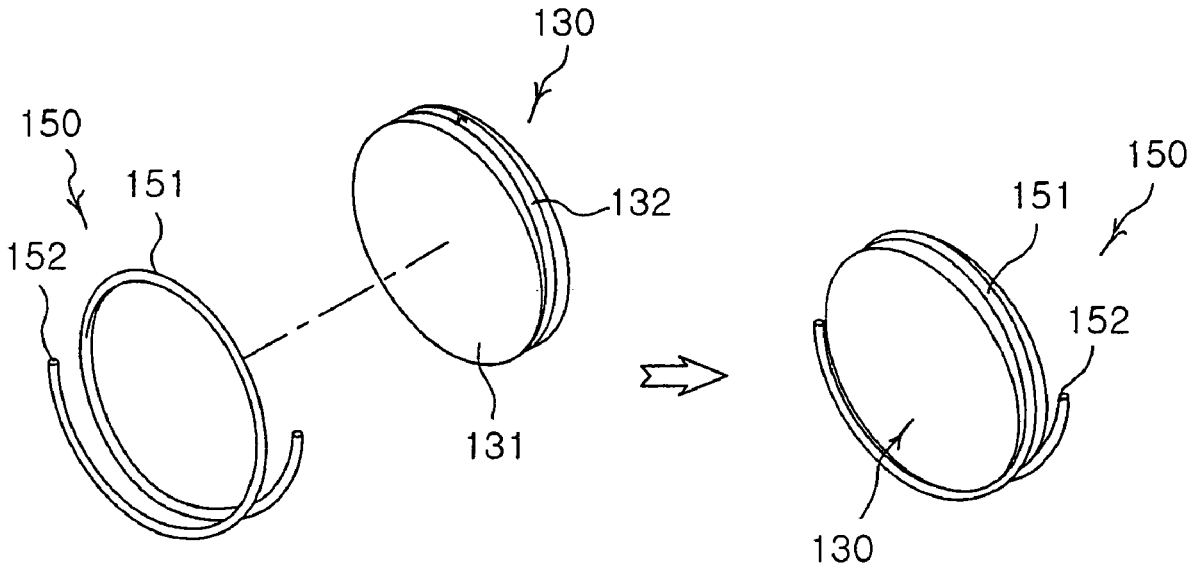
FIGS. 3*a*, 3*b*, 3*c*, 3*d* and 3*e* are perspective views respectively illustrating assembly of a mass member and an elastic wire provided at the vibration actuator according to the first preferred embodiment of the present invention.
Figure 3B:
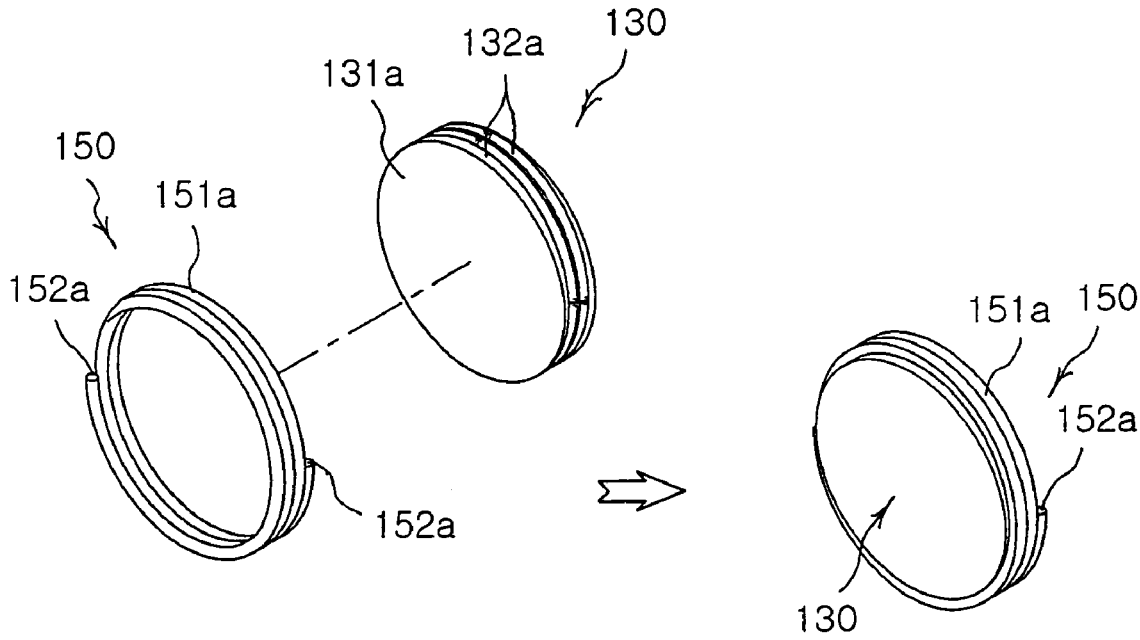
Figure 3C:
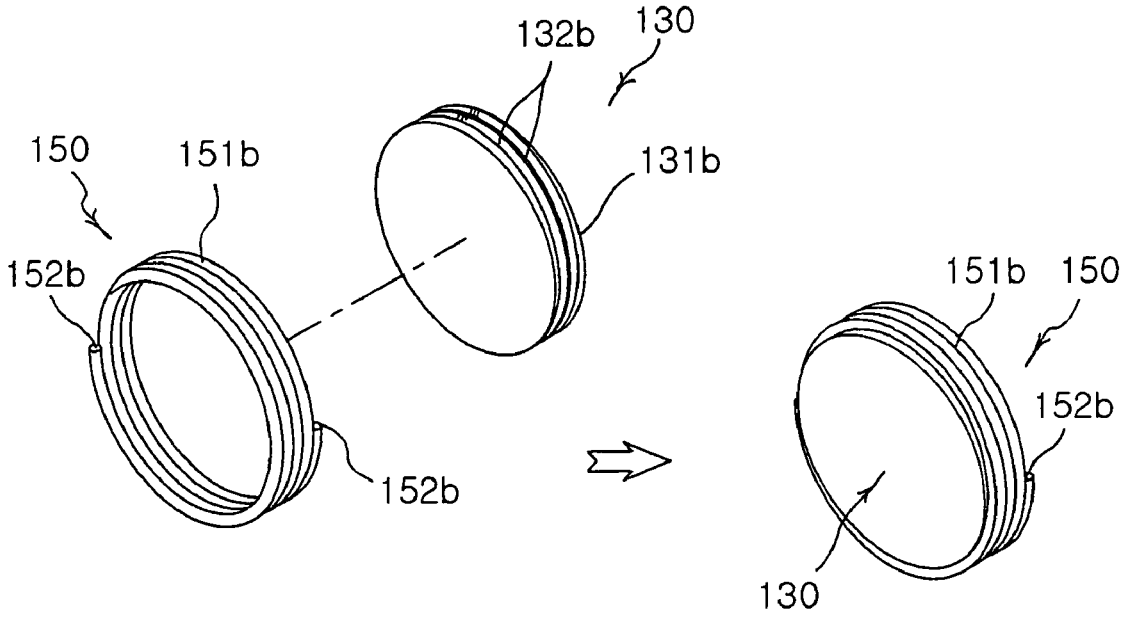

As shown in FIG. 3*a*, 3*b* or 3*c*, the elastic wire 150 may be composed of a coil spring comprising a wire body 151; 151*a*;

151*b* disposed in a disposition groove 132; 132*b*; 132*b* formed, in a helical shape having at least one turn, at the outer circumferential surface of a mass body 131; 131*a*' 131*b* of the mass member 130, and elastic ends 152; 152*a*; 152*b* fixed to the inner circumferential surface of the case 110.

The assembly of the mass member 130 and the elastic wire 150 is made as follows. The wire body 151; 151*a*; 151*b* may be wound around the disposition groove 132; 132*a*; 132*b* of the mass member 130, or the wire body 151; 151*a*; 151*b* may be forcibly fitted in the disposition groove 132; 132*a*; 132*b* of the mass member 130.

Figure 3D:
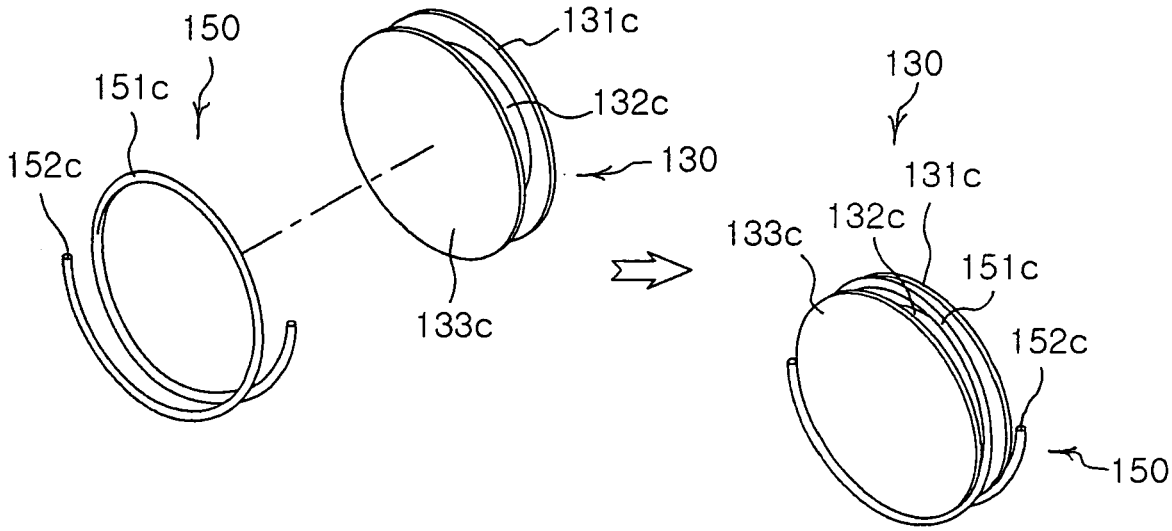

As shown in FIG. 3*d*, the mass member 130 may comprise: at least two mass disks 131*c* and 133*c* having different diameters, the at least two mass disks 131*c* and 133*c* being disposed while being vertically stacked; and a disposition groove 132 provided between the at least two mass disks 131*c* and 133*c* for allowing the wire body 151 of the elastic wire 150 to be disposed therein.

Figure 3E:
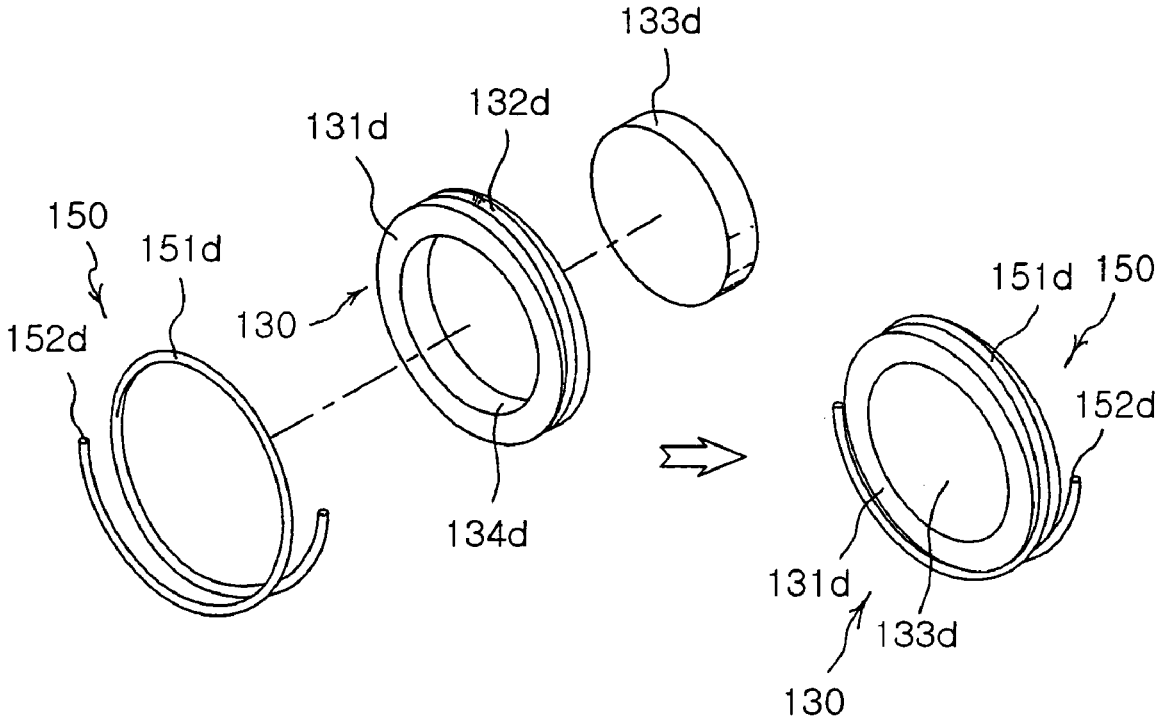

As shown in FIG. 3*e*, the mass member 130 may comprise: a hollow outer mass part 131*d* having a disposition groove 132*d* formed at the outer circumferential surface thereof, in a helical shape having at least one turn, for allowing the wire body 151 of the elastic wire 150 to be disposed therein and a center hole 134*d* formed through the center thereof, the center hole 134*d* having a predetermined size; and an inner mass part 133*d* inserted in the center hole 134*d*.

The outer mass part 131*d* may be made of a resin material having the disposition groove 132*d* and the center hole 134*d* formed by molding. Preferably, the outer mass part 131*d* made of the resin material may contain powder having high specific gravity, such as tungsten, to amplify a vertical exciting force together with the inner mass part 133*d*, which is made of a material having high specific gravity.

The magnetic field unit 140 disposed in the inner space of the case 110 comprises: a yoke 141 integrally fixed to the mass member 130 elastically supported by the elastic member 150; and a vertically magnetized magnet 142 mounted in the yoke 141. Preferably, the magnetic field unit 140 further comprises: an upper plate 143 disposed on the upper surface of the magnet 142 for concentrating magnetic flux discharged from the magnet 142, which generates a magnetic force having a predetermined strength.

At the opened upper part of the case 110 is preferably disposed a voice coil 160 for generating an electric field having a predetermined strength, when electric current is supplied to the voice coil 160, to output sound along with vibration. To the lower surface of the voice coil 160 is also preferably attached a diaphragm 170.

The diaphragm 170 is an oscillating plate having a thickness of 19 μm to 50 μm, which is manufactured by pressing a film material, such as polyetherimide (PEI), polyethylene terephthalate (PET) or polycarbonate (PC), at a high temperature of approximately 200° C. and at high pressure. The outer circumferential part of the diaphragm 170 is located at an inner upper end 117*a* of the case 110, and is fixedly supported by a supporting ring 117.

At a predetermined position of the outer circumferential surface of the case 110 is mounted a terminal part 112 for supplying electric current having different frequency bands to the vibration coil 120 and the voice coil 160. At the inner circumferential surface of the case 110 are mounted a plurality of engagement protrusions 114 having groove-shaped or hole-shaped engagement parts formed at the outer surfaces thereof, which correspond to the elastic ends 152 of the elastic wire 150, such that the elastic ends 152 of the elastic wire 150 can be easily and quickly engaged into the engagement parts of the engagement protrusions 114, respectively.

Figure 4:
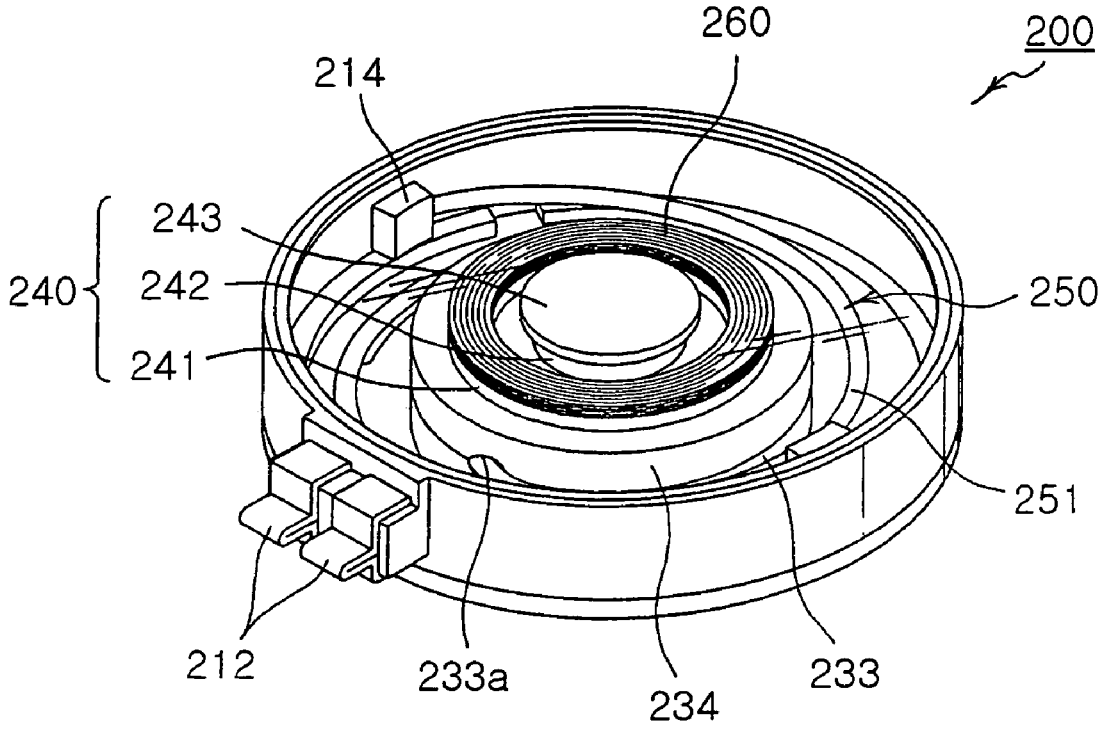
FIG. 4 is an assembled perspective view illustrating a vibration actuator according to a second preferred embodiment of the present invention.
Figure 5:
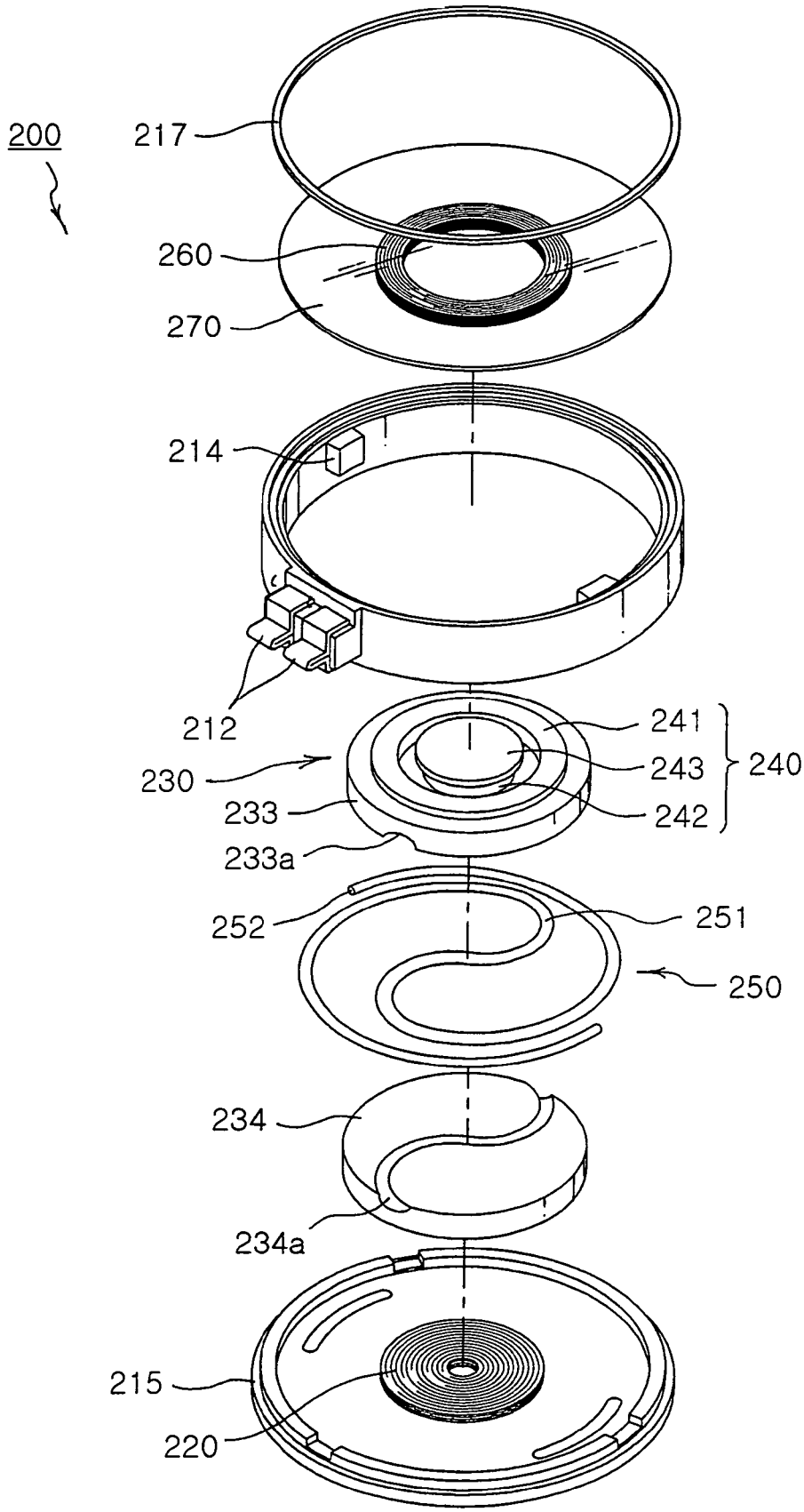
FIG. 5 is an exploded perspective view illustrating the vibration actuator according to the second preferred embodiment of the present invention.
Figure 6A:
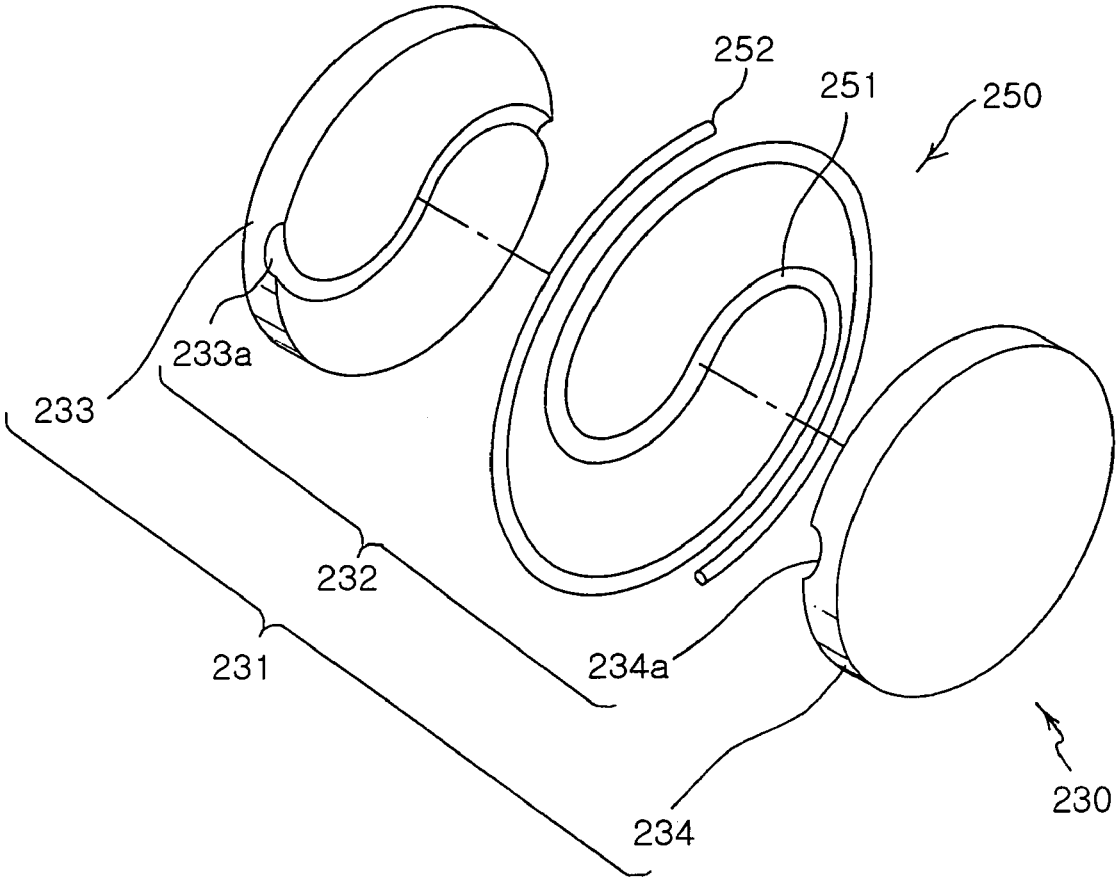
FIGS. 6*a* and 6*b* are an exploded perspective view and an assembled plan view respectively illustrating an example of a mass member and an elastic wire provided at the vibration actuator according to the second preferred embodiment of the present invention.
Figure 6B:
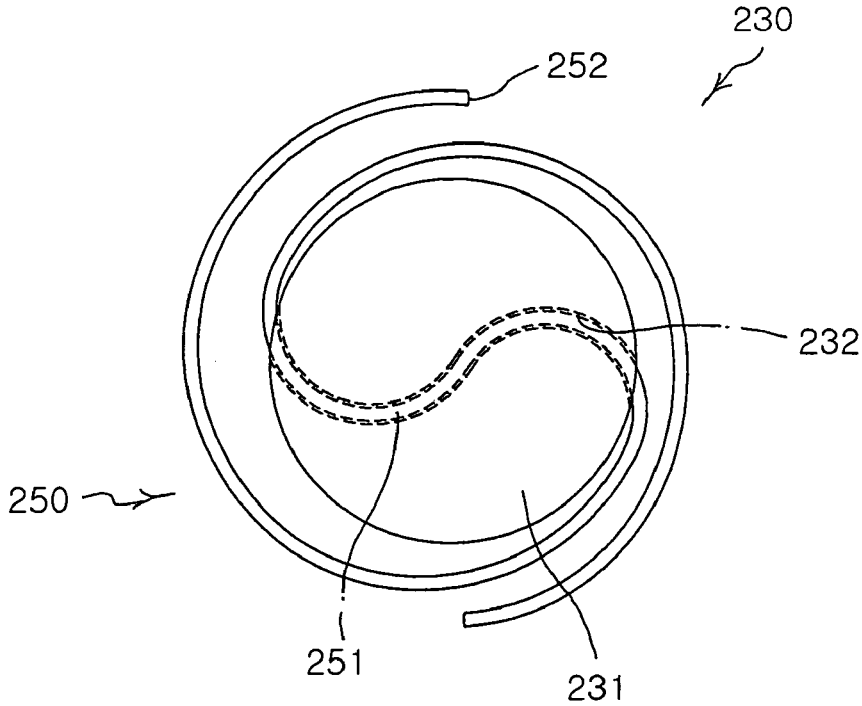

FIG. 4 is an assembled perspective view illustrating a vibration actuator 200 according to a second preferred embodiment of the present invention, FIG. 5 is an exploded perspective view illustrating the vibration actuator 200 according to the second preferred embodiment of the present invention, and FIGS. 6*a* and 6*b* are an exploded perspective view and an assembled plan view respectively illustrating an example of a mass member and an elastic wire provided at the vibration actuator 200 according to the second preferred embodiment of the present invention.

As shown in FIGS. 4 to 6, the vibration actuator 200 according to the second preferred embodiment of the present invention comprises: a case 210, a vibration coil 220, a mass member 230, a magnetic field unit 240, and an elastic wire 250, which are identical in construction to the components of the vibration actuator 100 according to the second preferred embodiment of the present invention, and therefore, a detailed description thereof will not be given.

The mass member 230, which is elastically supported by the elastic wire 250, is a weight vertically movably disposed in the inner space of the case 210. The mass member 230 has a mass body 231. In the mass body 231 of the mass member 230 is formed a disposition hole 132, both ends of which are exposed to the outside at the outer circumferential surface of the mass body 231 of the mass member 230.

Specifically, the disposition hole 232 of the mass member 230 comprises: an upper disposition groove 233*a* formed at the lower surface of an upper mass member 233 constituting the mass member 230; and a lower disposition groove 234*a* formed at the upper surface of a lower mass member 234 also constituting the mass member 230. The upper disposition groove 233*a* and the lower disposition groove 234*a* are vertically coupled with each other to form the disposition hole 232.

In this case, the mass member 230 comprises: the upper mass member 233 having the upper disposition groove 233*a* formed at the lower surface thereof; and the lower mass member 234 having the lower disposition groove 234*a* formed at the upper surface thereof, which is opposite to the lower surface of the upper mass member 233 where the upper disposition groove 233*a* is formed. The upper mass member 233 and the lower mass member 234 are coupled with each other to form the disposition hole 232. Alternatively, one of the upper and lower mass members 233 and 234 may be composed of a plate material for covering the upper disposition groove 233*a* or the lower disposition groove 234*a* to form the disposition hole 232.

Preferably, the disposition hole 232 is formed in the shape of a straight line or a curved line.

Also, the upper and lower mass members 233 and 234, which are coupled with each other to constitute the mass member 230, may have the same size, and therefore, the upper and lower mass members 233 and 234 may have the same weight. Alternatively, the upper and lower mass members 233 and 234 may have different sizes, and therefore, the upper and lower mass members 233 and 234 may have different weights.

The upper and lower mass members 233 and 234 are vertically coupled with each other by a plurality of coupling members. However, the upper and lower mass members 233 and 234 may be vertically coupled with each other by other means. For example, the upper and lower mass members 233 and 234 may be vertically coupled with each other by welding, or the upper and lower mass members 233 and 234 may be vertically coupled with each other by a bonding agent.

The elastic wire 250, which is disposed between the case 210 and the mass member 230 for elastically supporting the mass member 230, comprises: a wire body 251 disposed in the disposition hole 232 formed in the mass body 231 of the mass member 230; and elastic ends 252 extending from the wire body 251 and engaged in engagement protrusions 214 formed at the inner circumferential surface of the case 210.

As shown in FIGS. 6*a* and 6*b*, the elastic wire 250 may be composed of a wire comprising: a wire body 251 disposed in the disposition hole 232 of the mass member 230; and a pair of elastic ends 252 extending along the outer circumferential surface of the mass member 230 and fixed to the inner circumferential surface of the case 210.

Preferably, the elastic ends 252 of the elastic wire 250 are securely fixed to the inner circumferential surface of the case 210, while being spaced apart from each other by an angular distance of 180 degrees, to maximize elasticity of the elastic wire 250, which is necessary to elastically support the mass member 230.

Figure 7A:
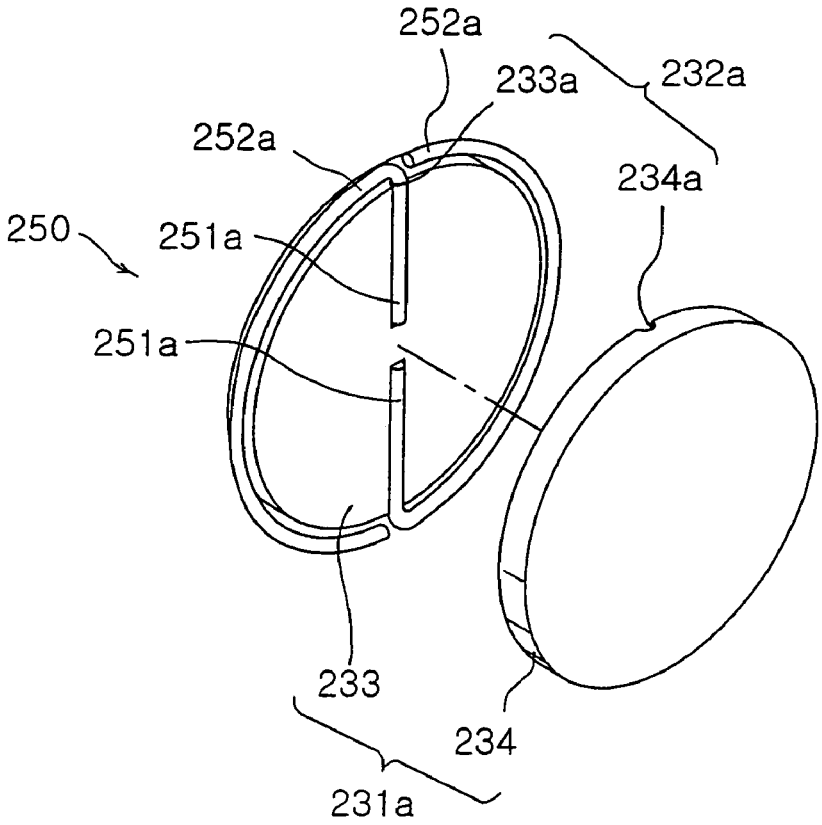
FIGS. 7*a* and 7*b* are an exploded perspective view and an assembled plan view respectively illustrating another example of a mass member and an elastic wire provided at the vibration actuator according to the second preferred embodiment of the present invention.
Figure 7B:
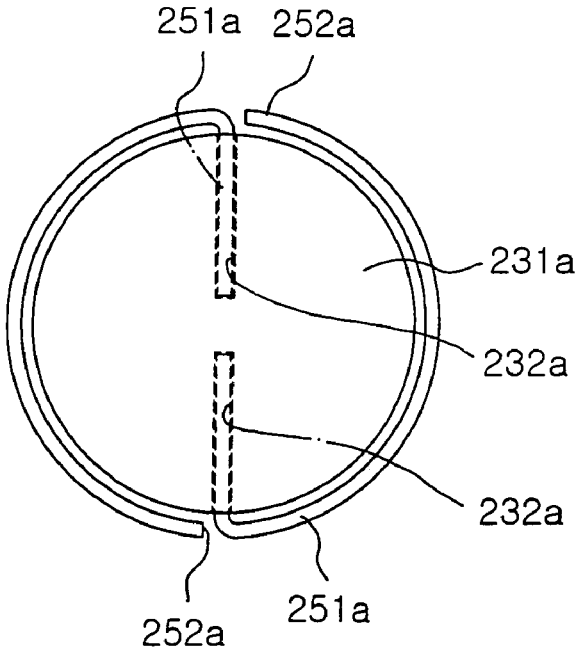

As shown in FIGS. 7*a* and 7*b*, the elastic wire 250 may be composed of at least two wires comprising: inner ends 251*a* fixedly disposed in at least two disposition holes 232*a* formed at a mass body 231*a* constituting the upper and lower mass members 233 and 234 such that the outer end of the disposition holes 232*a* is exposed to the outside at the outer circumferential surface of the mass body 231 of the mass member 230; and elastic ends 252*a* extending along the outer circumferential surface of the mass body 231*a* of the mass member 230 and fixed to the inner circumferential surface of the case 210.

In the illustrated drawings, the disposition holes 232*a* formed by vertical coupling of the upper and lower disposition grooves 233*a* and 234*a* formed at the upper and lower mass members 233 and 234 do not communicate with each other, although the disposition holes 232*a* may communicate with each other.

Preferably, the elastic ends 252*a* of the elastic wire 250 are securely fixed to the inner circumferential surface of the case 210, while being spaced uniformly apart from each other, to maximize elasticity of the elastic wire 250, which is necessary to elastically support the mass member 230.

Figure 8A:
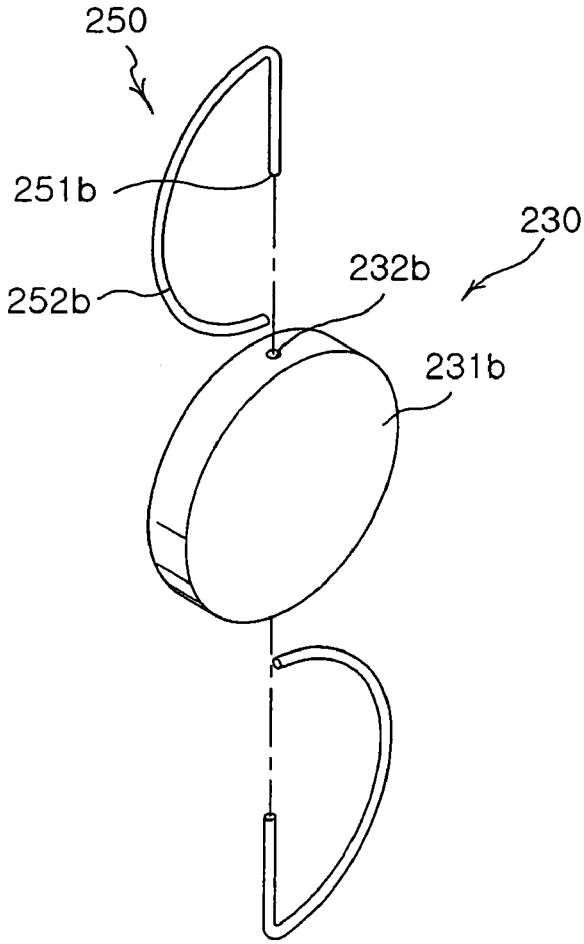
FIGS. 8*a* and 8*b* are an exploded perspective view and an assembled plan view respectively illustrating still another example of a mass member and an elastic wire provided at the vibration actuator according to the second preferred embodiment of the present invention.
Figure 8B:
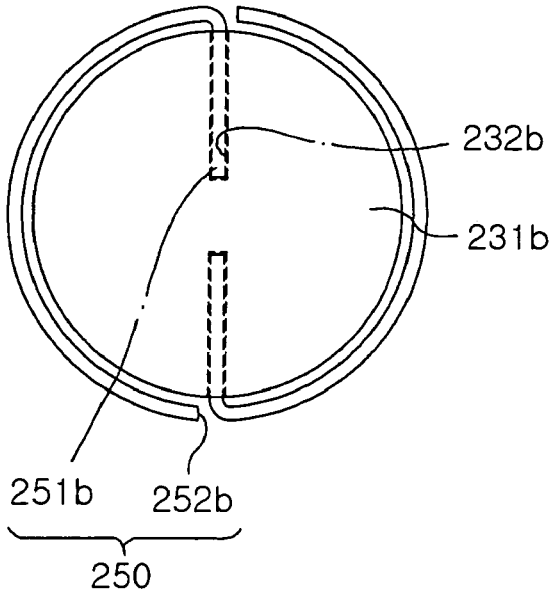

As shown in FIGS. 8*a* and 8*b*, the mass member 230, which is elastically supported by the elastic member 250 in the case 210, is a weight having at least two fixing holes 232*b* formed at the outer circumferential surface of a mass body 231*b* thereof while being spaced uniformly apart in the circumferential direction. The elastic wire 250 is composed of at least two wires each having one end 251*b* fixedly inserted in the corresponding fixing hole 232*b* and the other end 252*b* extending along the outer circumferential surface of the mass member 230 and securely fixed to the inner circumferential surface of the case 210.

Preferably, the elastic ends 252*b* of the elastic wire 250 are securely fixed to the inner circumferential surface of the case 210, while being spaced uniformly apart from each other, to maximize elasticity of the elastic wire 250, which is necessary to elastically support the mass member 230.

The engagement protrusions 214 having groove-shaped or hole-shaped engagement parts formed at the outer surfaces thereof, which correspond to the elastic ends 252; 252*a*; 252*b* of the elastic wire 250, are mounted at the inner circumferential surface of the case 210 such that the elastic ends 252; 252*a*; 252*b* of the elastic wire 250 can be easily and quickly engaged into the engagement parts of the engagement protrusions 214, respectively.

Figure 9A:
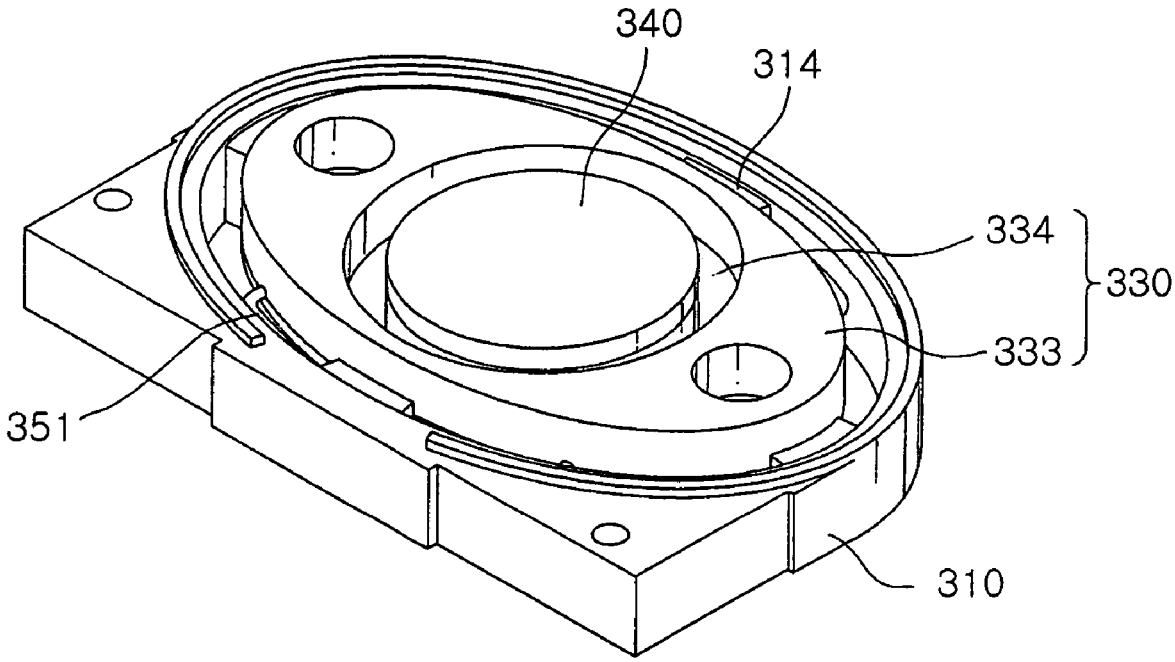
FIGS. 9*a* and 9*b* are an assembled perspective view and an exploded perspective view respectively illustrating an example of a mass member and an elastic wire provided at a case of the vibration actuator according to the present invention.
Figure 9B:
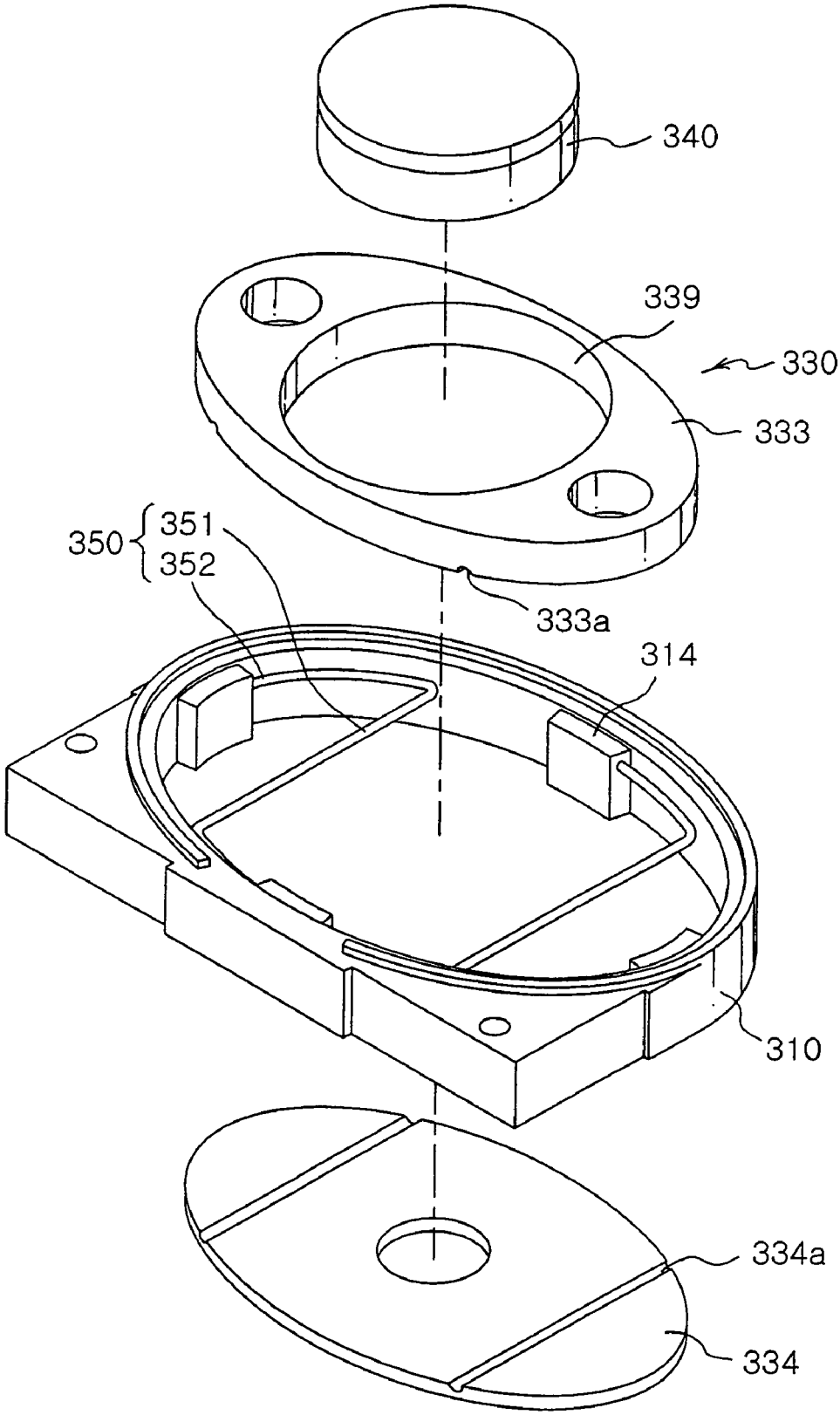

FIGS. 9*a* and 9*b* are an assembled perspective view and an exploded perspective view respectively illustrating an example of a mass member 330 and an elastic wire 350 provided at a case 310 of the vibration actuator according to the present invention. As shown in FIGS. 9*a* and 9*b*, a plurality of engaging protrusions 314, in which elastic ends of the elastic wire 350 are engaged, are mounted at the inner circumferential surface of the case 310.

In the illustrated drawings, the case 310 has an oval inner space, although the inner space of the case 310 may be formed in the shape of a circle based on forms of wireless communication devices.

The mass member 330 comprises: an upper mass member 333 having a mounting hole 339 formed through the center of a mass body thereof such that a magnetic field unit 340 is inserted in the mounting hole 339 of the upper mass member 333 and an upper groove 333*a* formed at the lower surface thereof; and a lower plate 334 having a lower groove 334*a* formed at the upper surface thereof such that the lower groove 334*a* and the upper groove 333*a* together form a disposition space where the elastic wire 350 is disposed when the lower groove 334*a* is vertically coupled with the upper groove 333*a*, the lower plate 334 partially covering the mounting hole 339.

The elastic wire 350 is composed of at least two wires comprising: wire bodies 351 disposed in a disposition part formed between the upper mass member 333 and the lower plate 334; and elastic ends 352 extending along the outer circumferential surfaces of the upper mass member 333 and the lower plate 334 and fixed to a plurality of engagement protrusions 314 formed at the inner circumferential surface of the case 310, respectively.

Consequently, the mass member 330, which comprises the upper mass member 333 and the lower plate 334, is elastically supported by elastic forces of the elastic wire 350 composed of the at least two wires, which is disposed between the case 310 and the mass member 330, such that the mass member 330 can be vertically moved.

Figure 10A:
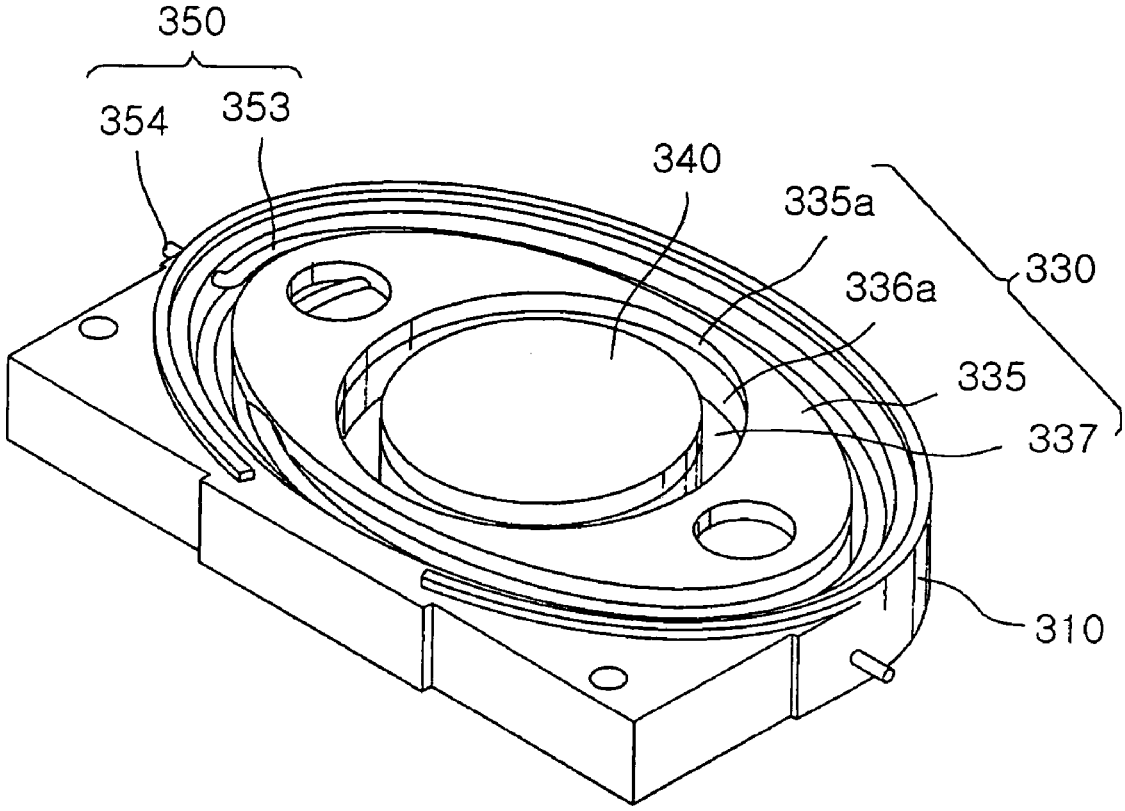
FIGS. 10*a* and 10*b* are an assembled perspective view and an exploded perspective view respectively illustrating another example of a mass member and an elastic wire provided at the case of the vibration actuator according to the present invention.
Figure 10B:
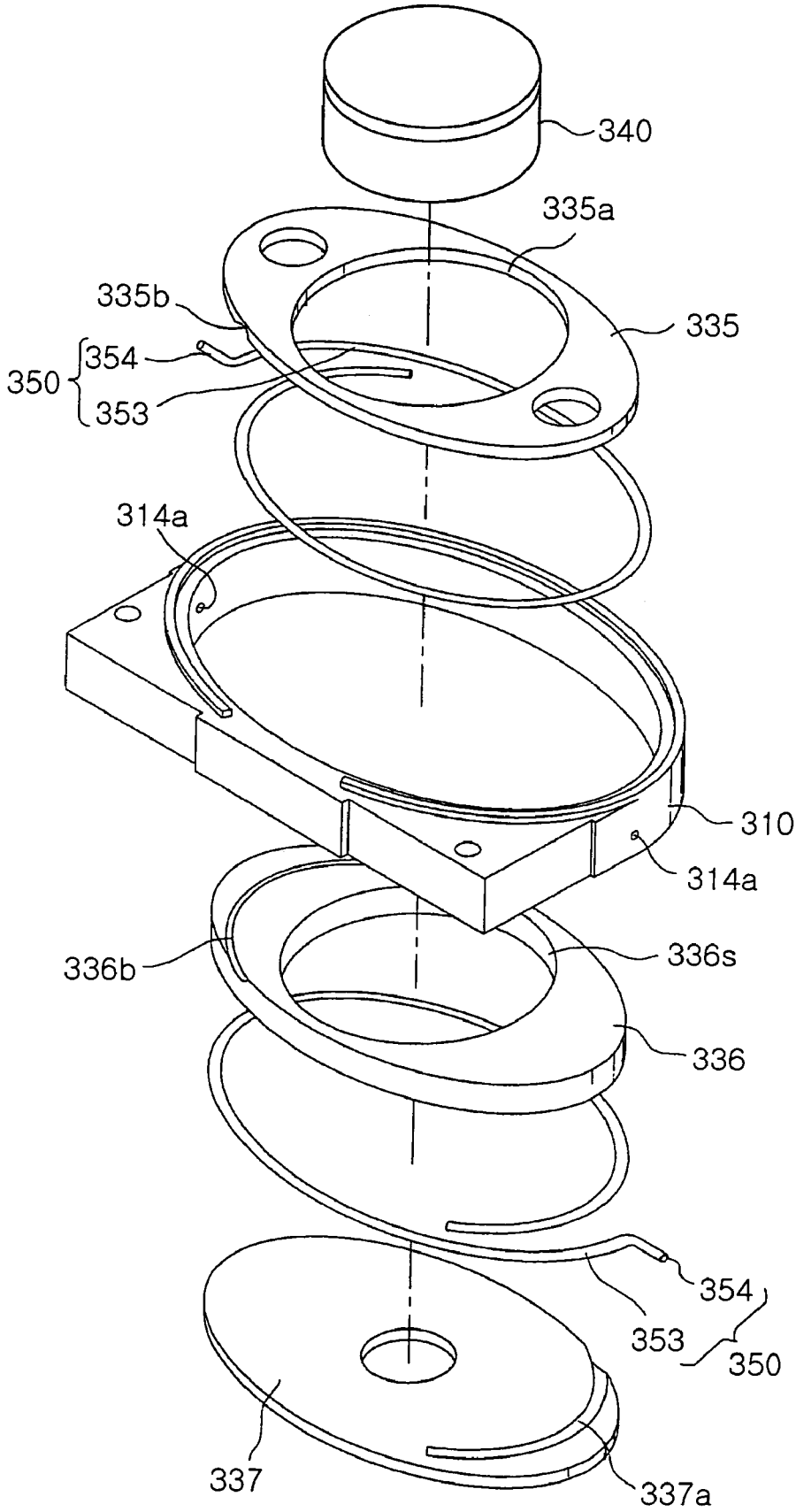

FIGS. 10*a* and 10*b* are an assembled perspective view and an exploded perspective view respectively illustrating another example of a mass member 330 and elastic wires 350 provided at the case 310 of the vibration actuator according to the present invention. As shown in FIGS. 9*a* and 9*b*, the case 310 has a plurality of insertion holes 314*a* formed therethrough from the inner circumferential surface thereof to the outer circumferential surface thereof for allowing elastic ends of the elastic wires 350 to be inserted therethrough.

The mass member 330 comprises: an upper mass member 335 having an upper mounting hole 335*a* formed through the center of a mass body thereof such that a magnetic field unit 340 is inserted in the upper mounting hole 335*a* of the upper mass member 335 and an upper groove 335*b* formed at the lower surface thereof; a lower mass member 336 having an lower mounting hole 336*a* formed therethrough, the lower mounting hole 336*a* corresponding to the upper mounting hole 335*a*, and a first intermediate groove 336*b* formed at the upper surface thereof, which corresponds to the upper groove 335*b*, such that a wire body 353 of an elastic wire 350 is disposed in the first intermediate groove 336*b* of the lower mass member 336, the lower mass member 336 being vertically coupled with the upper mass member 335; and a lower plate 337 having a lower groove 337*a* formed at the upper surface thereof, which corresponds to a second intermediate groove (not shown) formed at the lower surface of the lower mass member 336, such that a wire body 353 of another elastic wire 350 is disposed in the second intermediate groove of the lower mass member 336, the lower plate 337 being vertically coupled with the lower mass member 336 for partially covering the upper mounting hole 335*a* and the lower mounting hole 336*a*.

The elastic wires 350 disposed between the upper mass member 335 and the lower mass member 336 and between the lower mass member 336 and the lower plate 337, respectively, comprise a pair of upper and lower wires each having a wire body 353 fixedly disposed between the upper mass member 335 and the lower mass member 336 and between the lower mass member 336 and the lower plate 337, respectively, and an elastic end 354 extending along the outer circumferential surfaces of the upper mass member 335 and the lower mass member 336 and fixedly inserted in the corresponding insertion hole 314*a* formed at the inner circumferential surface of the case 310.

Consequently, the mass member 330, which comprises the upper mass member 335, the lower plate 336, and the lower plate 337, is elastically supported by elastic forces of the elastic wires 350, which are disposed between the case 310 and the mass member 330, such that the mass member 330 can be vertically moved.

Figure 11A:
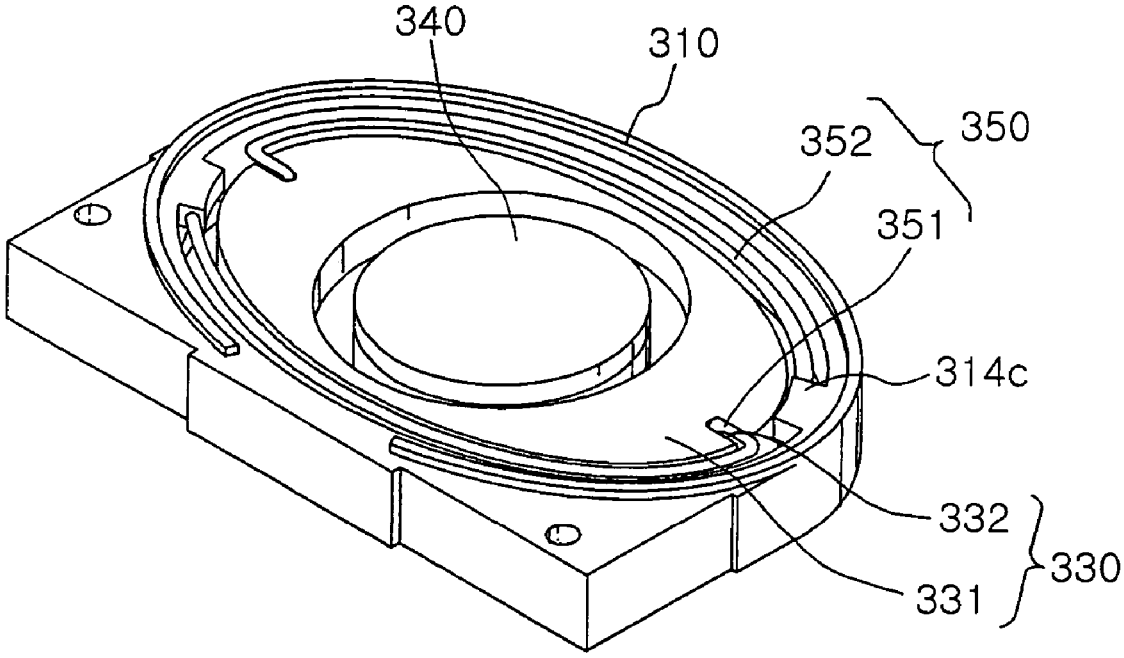
FIGS. 11*a* and 11*b* are an assembled perspective view and an exploded perspective view respectively illustrating another example of a mass member and an elastic wire provided at the case of the vibration actuator according to the present invention.
Figure 11B:
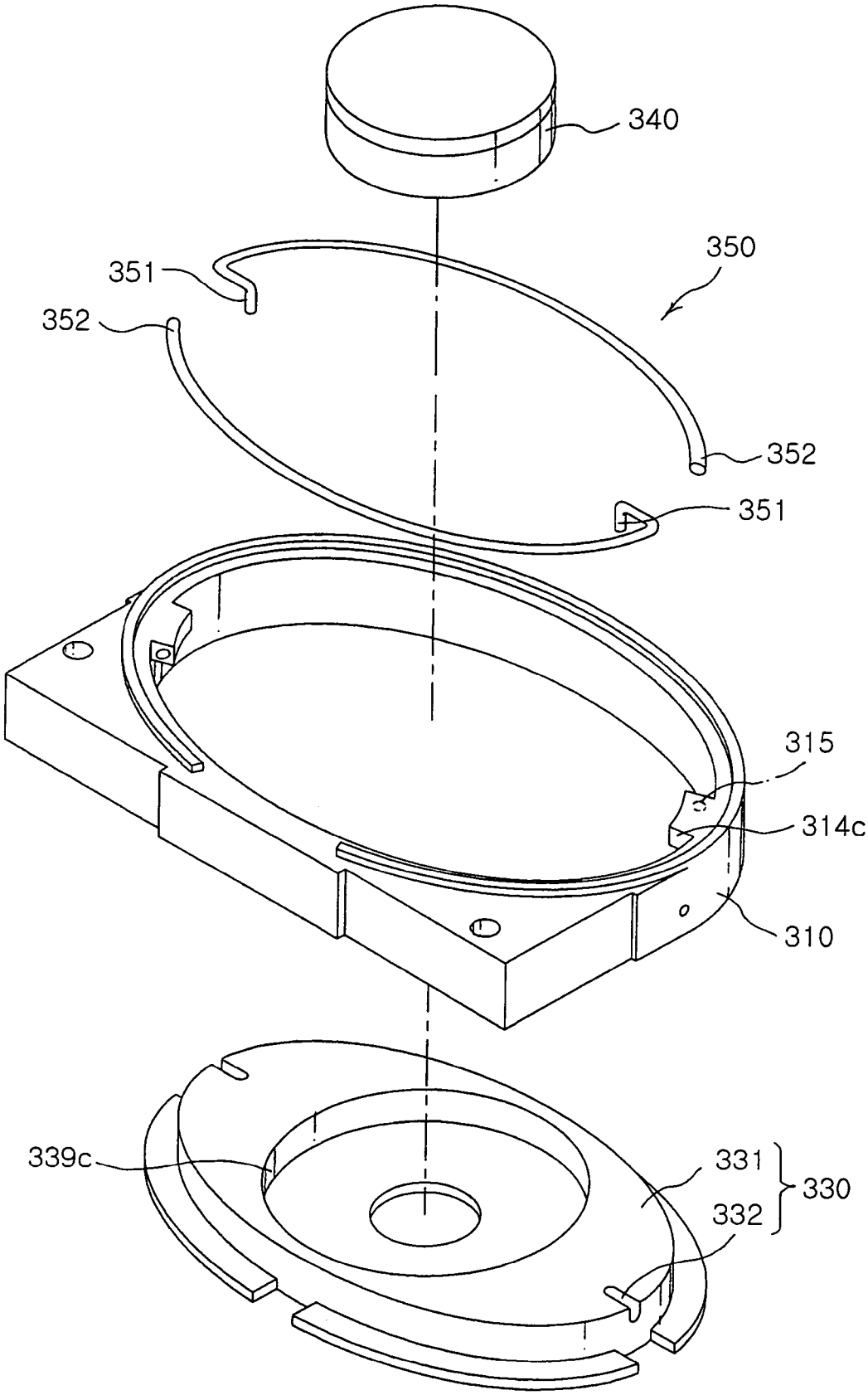

FIGS. 11*a* and 11*b* are an assembled perspective view and an exploded perspective view respectively illustrating another example of a mass member 330 and an elastic wire 350 provided at the case 310 of the vibration actuator according to the present invention. As shown in FIGS. 11*a* and 11*b*, a plurality of engaging protrusions 314*c*, in which elastic ends of the elastic wire 350 are engaged, are mounted at the inner circumferential surface of the case 310.

The mass member 330 is a weight comprising: a mass body 331 having a mounting hole 339*c* formed through the center thereof such that a magnetic field unit 340 is inserted in the mounting hole 339*c* of the mass member 330; and fixing grooves 332 formed at the upper surface of the mass body 331 for allowing ends 355 of the elastic wire 350 to be vertically inserted therein.

The elastic wire 350, which elastically supports the mass member 330 in the case 310, is composed of at least two wires each having one end 351 fixedly inserted in the corresponding fixing groove 332 of the mass member 330 and the other end 352, which is an elastic end, extending along the outer circumferential surface of the mass member 330 and engaged in the corresponding engagement protrusion 114 of the case 310.

Figure 12A:
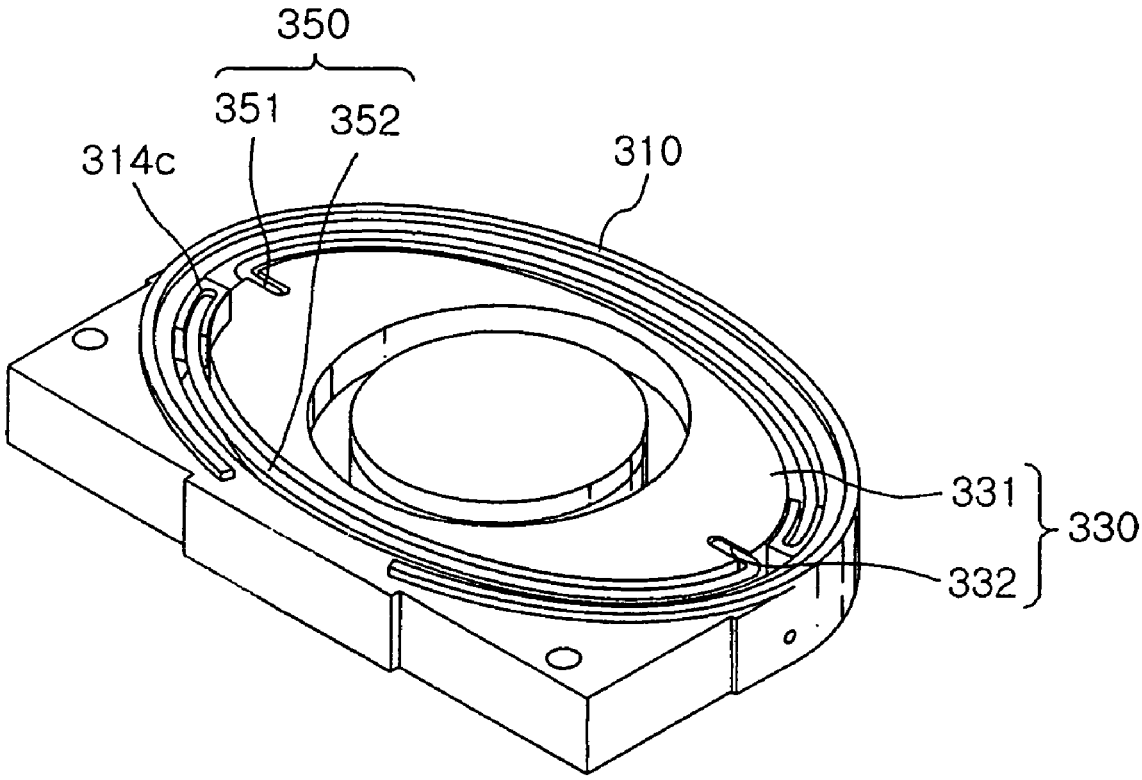
FIGS. 12*a* and 12*b* are an assembled perspective view and an exploded perspective view respectively illustrating another example of a mass member and an elastic wire provided at the case of the vibration actuator according to the present invention.
Figure 12B:
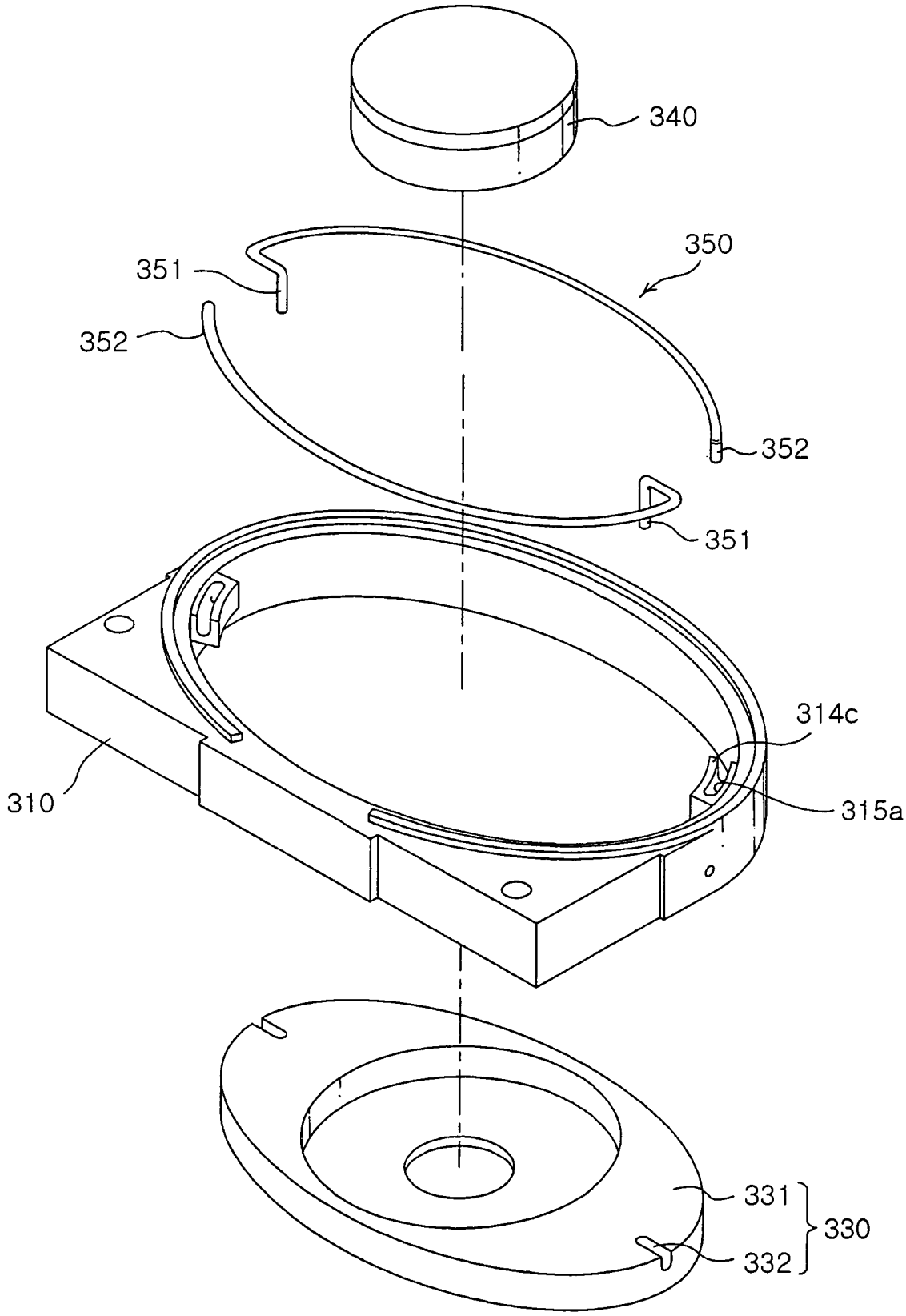
Figure 13:
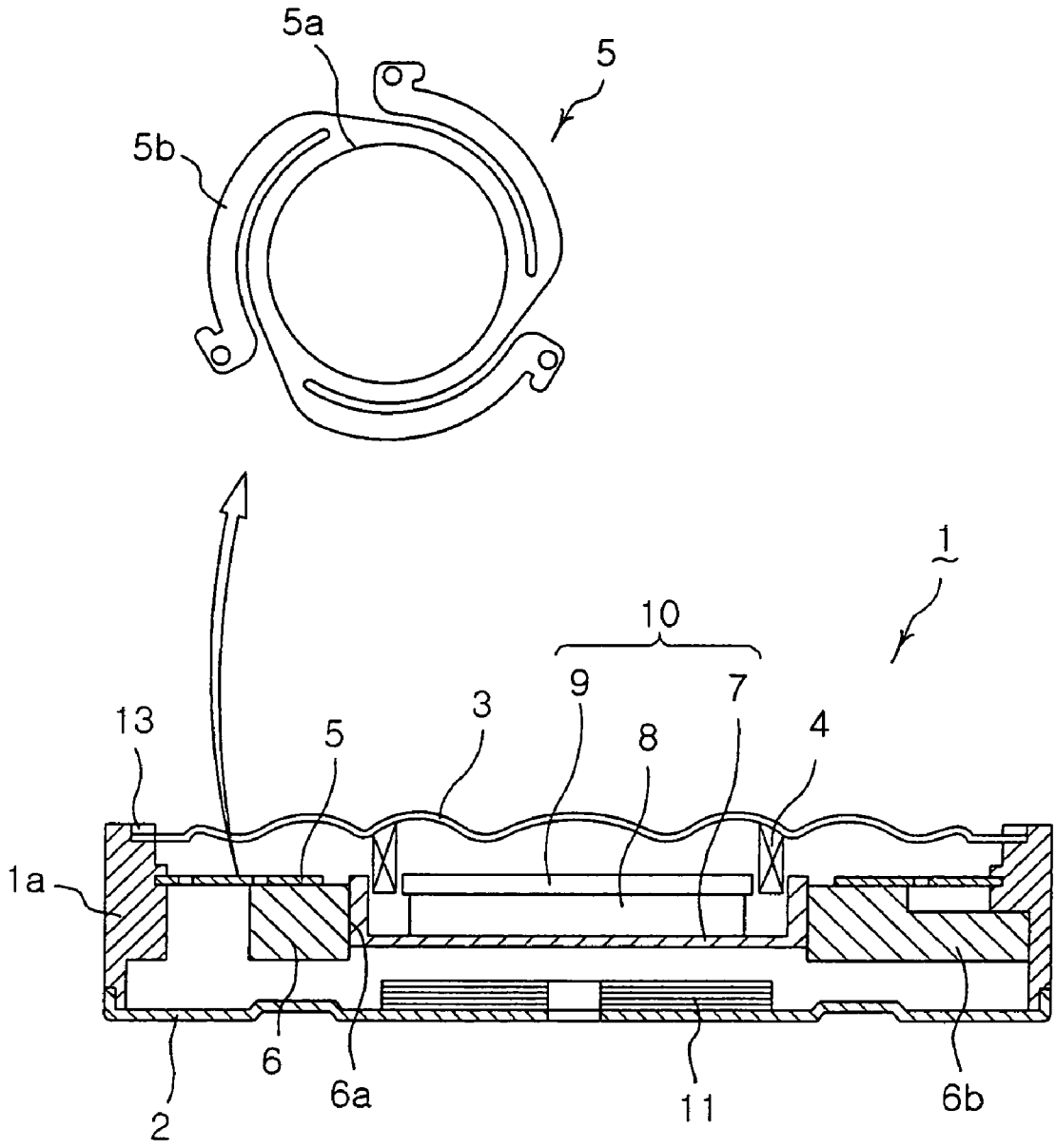
Prior art FIG. 13
FIG. 13 is a cross-sectional view illustrating a conventional vibration actuator.

As shown in FIGS. 11*a* and 11*b*, the elastic ends 352 of the elastic wire 350 are inserted into insertion holes 315 formed at the side surfaces of the engaging protrusions 314*c* of the case 310 in the circumferential direction. Alternatively, the elastic ends 352 of the elastic wire 350 may be vertically fitted into a fitting grooves 315*a* formed at the upper surfaces of the engaging protrusions 314*c* of the case 310, as shown in FIGS. 12*a* and 12*b*.

When an electric field having a predetermined strength is generated by the vibration coil 120; 220 as electric current having a low frequency of 120 to 300 Hz to the vibration coil 120; 220 of the vibration actuator 100; 200 with the above-stated construction according to the present invention, the mass member 130; 230, including the magnetic field unit 140, is vertically vibrated in the inner space of the case 110; 210 by interaction between the electric field generated by the vibration coil 120; 220 and the magnetic field generated by the magnetic field unit 140, since the mass member 130; 230 is elastically supported by the elastic wire 150; 250 whose wire body is fixed to the mass member 130; 230 and whose elastic ends are fixed to the case 110; 210. The vibration is transmitted to the case 110; 210 via the elastic wire 150; 250 such that the vibration actuator 100; 200 is vibrated.

When an electric field having a predetermined strength is generated by the voice coil 160; 260 as electric current having a high frequency of 200 Hz or more to the voice coil 160; 260 of the vibration actuator 100; 200, the diaphragm 170; 270 is minutely oscillated by interaction between the electric field generated by the vibration coil 120; 220 and the magnetic field generated by the magnetic field unit 140, since the voice coil 160; 260 is mounted to the diaphragm 170; 270 disposed at the opened upper part of the case 110; 210. Consequently, sound or voice is generated.

As apparent from the above description, the disposition groove is formed at the outer circumferential surface of the mass body of the mass member including the magnetic field unit, or the disposition hole is formed in the mass body of the mass member, and the elastic ends of the elastic wire disposed in the disposition groove or the disposition hole are fixed to the inner circumferential surface of the case such that the mass member elastically supported in the case. Consequently, the present invention has the effect of improving durability due to high fatigue strength of the metal wire used in manufacturing springs, and therefore, increasing the service life of the vibration actuator.

According to the present invention as described above, change of the natural frequency of elastic member due to manufacturing tolerance is minimized while the natural frequency of the elastic member for elastically supporting a vibrator comprising the magnetic field unit and the mass member is constantly maintained. Consequently, the present invention has the effect of guaranteeing good quality while equalizing quality of mass-produced vibration actuators, and improving vibration characteristics of the vibration actuator.

Furthermore, assembly of the mass member and the elastic wire, which elastically supports the mass member, is more easily and conveniently accomplished. Consequently, the present invention has the effect of simplifying and reducing a manufacturing process of the vibration actuator, and therefore, improving productivity of the vibration actuator.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A vibration actuator for a mobile communications device, for exciting a mass member by interaction between an electric field of a vibration coil provided in an inner space of a case and a magnetic field of a magnetic field unit disposed corresponding to the vibration coil, wherein the vibration actuator comprises:

an elastic wire having a wire body fixed to the outer surface of the mass member and elastic ends fixed to the inner surface of the case, the elastic wire being connected between the case and the mass member for elastically supporting the mass member;

wherein the mass member has a disposition groove formed, in a helical shape having at least one turn, at the outer surface thereof.

2. The actuator as set forth in claim 1, wherein the elastic wire is composed of a coil spring comprising a coil body disposed in the disposition groove and elastic ends fixed to the inner surface of the case.

3. The actuator as set forth in claim 1, wherein the wire body of the elastic wire is wound around the disposition groove of the mass member.

4. The actuator as set forth in claim 1, wherein the wire body of the elastic wire is forcibly fitted in the disposition groove of the mass member.

5. The actuator as set forth in claim 1, wherein the mass member comprises:

at least two mass disks having different diameters, the at least two mass disks being stacked on each other with an end face of one of the mass disks facing another end face of the other mass disk; and wherein the disposition groove is provided between the at least two mass disks and the wire body of the elastic wire is disposed in the disposition groove.

6. A vibration actuator for a mobile communications device, for exciting a mass member by interaction between an electric field of a vibration coil provided in an inner space of a case and a magnetic field of a magnetic field unit disposed corresponding to the vibration coil, wherein the vibration actuator comprises:

an elastic wire having a wire body fixed to the outer surface of the mass member and elastic ends fixed to the inner surface of the case, the elastic wire being connected between the case and the mass member for elastically supporting the mass member;

wherein the mass member comprises:

a hollow outer mass part having a disposition groove formed, in a helical shape having at least one turn, at the outer surface of said hollow outer mass part, and a center hole formed through the center of said hollow outer mass part, the center hole having a predetermined size; and an inner mass part inserted in the center hole.

7. A vibration actuator for a mobile communications device, for exciting a mass member by interaction between an electric field of a vibration coil provided in an inner space of a case and a magnetic field of a magnetic field unit disposed corresponding to the vibration coil, wherein the vibration actuator comprises:

an elastic wire having a wire body fixed to the outer surface of the mass member and elastic ends fixed to the inner surface of the case, the elastic wire being connected between the case and the mass member for elastically supporting the mass member;

wherein the mass member is made of a resin material having a disposition groove formed by molding.

8. The actuator as set forth in claim 1, wherein the magnetic field unit comprises:

a yoke fixed to the mass member; and a magnet mounted in the yoke.

9. The actuator as set forth in claim 8, wherein the magnetic field unit further comprises:

an upper plate disposed on the upper surface of the magnet.

10. The actuator as set forth in claim 1, further comprising:

a shield plate for closing an opened lower part of the case, the vibration coil being disposed on the upper surface of the shield plate.

11. The actuator as set forth in claim 1, further comprising:

a voice coil disposed at an opened upper part of the case for generating an electric field when an electric current is supplied to the voice coil; and a diaphragm attached to the lower surface of the voice coil.

12. The actuator as set forth in claim 1, wherein the mass member comprises:

a hollow outer mass part having the disposition groove formed at the outer surface thereof, and a center hole formed through the center thereof, the center hole having a predetermined size; and an inner mass part inserted in the center hole.

13. The actuator as set forth in claim 1, wherein the mass member is made of a resin material having the disposition groove formed by molding.

* * * * *